United States Patent [19]

Brattström et al.

[11] Patent Number: 4,487,130

[45] Date of Patent: Dec. 11, 1984

[54] HOLLOW CHARGE

[75] Inventors: Leif Brattström; Stig Hallström; Bo Gustavsson, all of Karlskoga, Sweden; Kjell Mattsson, San Leandro, Calif.

[73] Assignee: AB Bofors, Bofors, Sweden

[21] Appl. No.: 456,908

[22] Filed: Jan. 10, 1983

[30] Foreign Application Priority Data

Jan. 15, 1982 [SE] Sweden ..... 8200195

[51] Int. Cl.[3] ..... F42B 1/02

[52] U.S. Cl. ..... 102/476

[58] Field of Search ..... 102/306, 307, 476

[56] References Cited

U.S. PATENT DOCUMENTS

| | | | |
|---|---|---|---|
| 2,972,948 | 2/1961 | Kray | 102/476 |
| 3,135,205 | 6/1964 | Zwicky | 102/476 |
| 4,111,126 | 9/1978 | Thomanek | 102/476 |
| 4,259,906 | 4/1981 | Krauch, Jr. et al. | 102/306 |

FOREIGN PATENT DOCUMENTS

| | | | |
|---|---|---|---|
| 131701 | 11/1945 | Australia | 102/476 |
| 7605024-4 | of 0000 | Sweden . | |
| 940705 | of 0000 | United Kingdom . | |
| 1246028 | of 0000 | United Kingdom . | |
| 2081851 | of 0000 | United Kingdom . | |
| 839872 | 6/1960 | United Kingdom | 102/306 |

*Primary Examiner*—Charles T. Jordan
*Assistant Examiner*—Ted L. Parr
*Attorney, Agent, or Firm*—Pollock, Vande Sande & Priddy

[57] ABSTRACT

A hollow charge for causing a primary effect by making a hole in a target (1) and a secondary effect by charge material emanating into the target via this hole (1*a*) and causing a sudden pressure rise, fire, fragmentation, poison or a corresponding damaging effect within the target. The charge comprises a cavity (9) expanding in the burst direction and covered with a metal layer (10). At the initiation of the charge a forward directed penetrating jet (2) having a high velocity ($v_1$, $v_2$) is generated and also a slug (3) with a comparatively low velocity ($v_3$). The charge further comprises an additional body (11) in front of or integrated with the metal layer for generating a separate jet part (4) at the initiation of the charge, which part (4) follows behind the penetrating jet (2) and is included in the charge material causing the secondary effect. The additional body is arranged in such a way that the separate jet part (4) is in front of and separated from the slug and has a velocity which is well above the slug velocity ($v_3$).

14 Claims, 2 Drawing Figures

HOLLOW CHARGE

TECHNICAL FIELD

The present invention relates to a hollow charge for causing a primary effect by making a hole in a target and a secondary effect by penetration of charge material through this hole into the target, thereby causing a damaging effect in the form of pressure, fire, fragmentation and/or poison or the like inside the target. The charge comprises a cavity extending in the longitudinal, jet-forming direction of the charge. The cavity is covered with a metal layer, which generates for the primary effect a forward directed penetrating jet having a comparatively high velocity as well as a so-called slug following the penetration jet but with a comparatively low velocity. The charge further comprises an additional body arranged in front of or integrated with the metal layer to generate at the initiation of the charge a separate part accompanying the penetrating jet and intended to be included in the charge material causing the secondary effect.

BACKGROUND ART

It is previously known to use hollow charges in different types of ammunition units. Such ammunition units are used for penetrating the armour protection of battle tanks, vessels or the like.

It is also previously known to generate a penetrating jet having a substantial armour piercing capability. The velocities of the jet particles in different parts of the jet are comparatively high and as an example it could be mentioned that the velocity of jet particles in the front of the jet can be as high as 10000 m/s. But, the velocities decrease toward the rear parts of the jet where the jet particles have velocities of about 3000 m/s only. The velocities are determined by the design of the metal layer, the charge material, and so forth.

It has been proved that only about 15% of the mass of the metal layer is converted into the penetrating or working jet, and the additional part of the metal layer, i.e. about 85%, forms the slug which comes behind the penetrating jet with a comparatively low velocity, approximately 500 m/s in this example.

The additional body which is arranged at the front parts of the metal layer has previously also been converted into the low-velocity slug material.

DISCLOSURE OF THE INVENTION

Technical Problem

Because of the low velocity of the slug and its design in other respects it has, especially in case of thicker armour protections, as a rule no capability to penetrate the comparatively long and small hole made by the penetration jet and, as a consequence, the slug material is fastened in the hole. Then it should be noticed that the outer diameter of the slug clearly exceeds the hole diameter. This fact also has the consequence that the desired secondary effect has not been achieved.

SOLUTION

One purpose of the present invention is to solve the above-mentioned problem. A characterizing feature of the hollow charge according to the invention is the specific arrangement of the additional body to provide the separate part in front of and separated from the slug and with a velocity which clearly exceeds the slug velocity.

In further embodiments of the invention the additional body is arranged to generate the separate part formed as a projectile and following just at the rear part of the penetration jet with substantially the same velocity as the velocity of the rear parts of the penetrating jet.

In further embodiments of the invention it is also proposed more in detail how the hollow charge should be designed in order to provide a very efficient damaging effect but still a technically simple and unexpensive solution with respect to the manufacture of the charge.

The characterizing features of the new charge are more fully described in the appended claims.

ADVANTAGES

By the proposed invention an effective penetration function is obtained even for comparatively thick target armour protections. In the case the particles of the rear parts of the penetrating jet have a velocity of for instance about 3000 m/s, the velocity of the following separate part, preferably formed as an arrow head or a projectile, is about 2800 m/s, i.e., a velocity which clearly exceeds the slug velocity of about 500 m/s. By the proposed design an efficient so-called tandem jet is generated which has a significant secondary effect. It should be pointed out that the projectile formed separate part not only penetrates the hole made by the penetrating jet but also makes the hole larger so that also the slug which follows the separate part also can pass the hole. dr

DESCRIPTION OF THE DRAWINGS

One at present proposed embodiment of the hollow charge according to the invention will be more fully described with reference to the attached drawings in which FIG. 1 schematically illustrates the different parts of a hollow charge jet according to the invention and their relative positions after the initiation of the charge at a target, and FIG. 2 shows an embodiment according to the invention in which the hollow charge has been integrated in a shell or the like.

BEST MODE FOR CARRYING OUT THE INVENTION

Figure 1:
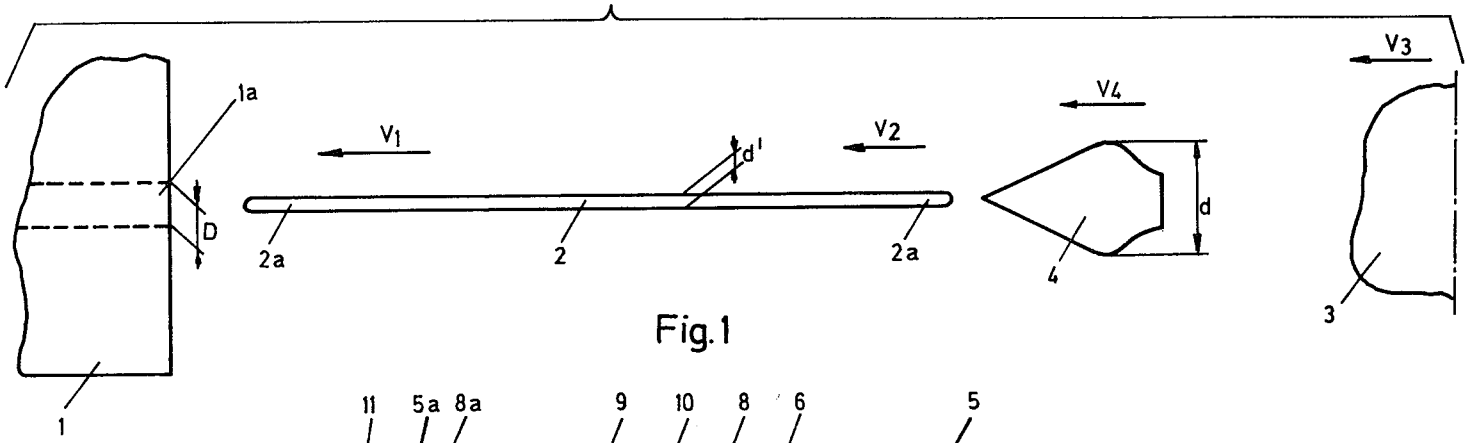

FIG. 1 a target object 1 could be provided with an armour protection which should be penetrated by the ammunition unit in order to cause a damaging effect in the form of pressure, fire, fragmentation or poison within the target. An ammunition unit in the form of a hollow charge than works with a primary effect as well as a secondary effect. The primary effect is caused by a penetrating or working hollow charge jet 2 which makes a hole in the armour protection. The secondary effect is caused by the charge material which passes the hole and provides the desired sudden rise of pressure, fire, fragmentation and/or poison or the like within the target. The hole in the armour protection made by the penetrating jet is indicated by dashed lines 1*a*.

According to the invention the hollow charge generates a penetrating jet having a comparatively high piercing capability. A characterizing feature of this hollow charge is the fact that the different particles of the front part of the penetrating jet have a comparatively high velocity, for instance the particles of the front part 2*a* of the jet have a velocity $v_1$ of about 10000 m/s. Looking backwards in the jet the velocity of the particles is decreasing so that the velocity $v_2$ of the particles is the rear parts of the jet is only about 3000m/s.

Hollow charges of this type also generate a slug body 3 in addition to the penetrating jet the slug body having a comparatively low velocity $v_3$, in this example about 500 m/s. The outer diameter of the slug clearly exceeds the diameter D of the hole 1*a* made by the penetrating jet.

According to the invention there is also a separate part 4 which is generated by the charge and which follows the penetrating jet but which is separated from the slug 3. part 4 has a velocity $v_4$ which largely exceeds the slug velocity $v_3$. In a preferred embodiment this separate part 4 has a velocity $v_4$ which is substantially the same as but below the velocity $v_2$ of the rear parts of the penetrating jet by no more than 1000 m/s, preferably 500 m/s. In this embodiment the separate part 4 has a velocity $v_4$ of about 2800 m/s, i.e. about 200 m/s less than the velocity $v_2$ and approximately 2300 m/s more than the velocity $v_3$ of the slug 3.

In the preferred embodiment the separate part 4 is also formed as an arrow head or projectile which makes it easier for this part to pass the hole 1*a*. The maximal diameter of the part 4 exceeds the diameter D of the hole 1*a*, but due to the velocity $v_4$ of the part 4 and to some extent also to its form, a substantial piercing capability is obtained for the part 4 in the hole 1*a*. The diameter d of the part 4 exceeds the diameter d' of the penetrating jet in this example by approximately 10 times. The invention is not limited to this figure, however; and the diameter d can for instance be 5–30 times more than said diameter d' of the penetrating jet. The part 4 could also be considered as an extension of the penetrating jet so that the jet 2 and the part 4 from a so-called tandem jet. The part 4 makes the hole 1*a* larger so that it is more easy for the accompanying slug to pass the hole 1*a*. The part 4 also increases the secondary damaging effect in the form of fragmentation, sudden pressure, fire and/or poison spreading which effect in some cases is accentuated by the accompanying slug.

Figure 2:
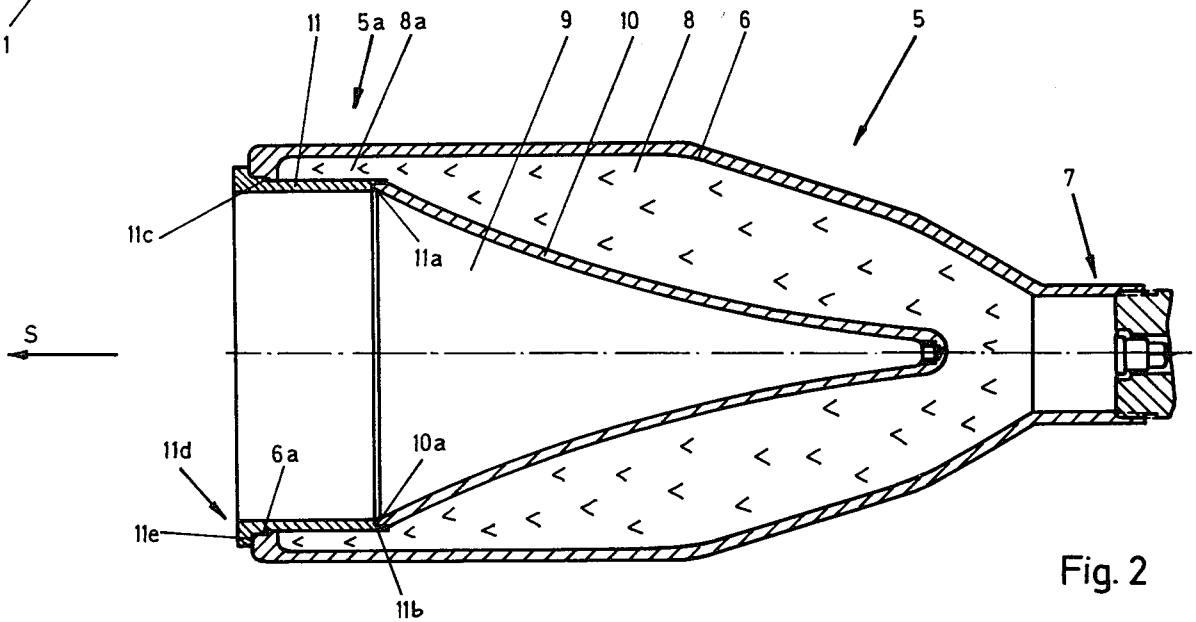

A hollow charge for producing the above-mentioned jet configuration is illustrated in FIG. 2. The hollow charge is an integrated part of a shell or the like in which the warhead forms the intermediate or rear part. The hollow charge 5 comprises an outer casing 6 and at the rear part means 7 for initiating the charge. It should be pointed out that the shell or the like is initiated in a way which is known by itself on a predetermined distance from the target surface so that an optimized jet configuration like in FIG. 1 is achieved.

The charge inside the casing 6 comprises a rotationally symmertric body of explosive 8, for instance cast-loaded hexatol. The charge is provided with an internal cavity or hollow 9 covered with a metal layer 10, for instance a copper layer. The cavity 9 is mainly conical, with its outer surface somewhat concave. The top of the cone is located at the rear part and the cone expands in the charge jet direction indicated by the arrow S.

At the end 5*a* of the charge the metal layer is finished off within the explosive and substantially cylindric ring 11 is arranged at the forwardmost part of the charge, partly countersunk into the explosive 8. The ring is then countersunk into the explosive more than 50% of its axial length direction, preferably 60–90%. The cylindric ring is made of zirconium, titanium, aluminium or an equivalent metal. The ring is then surrounded by the annular explosive part 8*a* and the thickness of the ring is 2–10% of the outer caliber of the ammunition unit. The weight of the ring is approximately 175 grams for a 70 mm caliber ammunition unit. The weight of the ring can be varied however between 100 and 250 grams, preferably 150–200 grams.

The inner end surface 11*a* of the ring is in contact with the corresponding end surface 10*a* of the metal layer so that a substantially tight connection is obtained. The end surface 11*a* of the ring is provided with a flange 11*b* enclosing a small part of the outer surface of the metal layer at the end 10*a*. The ring is further provided with an external thread 11*c* at the outer end 11*d*. By means of this thread the ring can be fastened in a corresponding internal thread 6*a* in the outer casing 6. At end 11*d* the ring also is provided with a guide flange 11*e*.

When the charge 8 is initiated the metal layer 10 is compressed, starting at the top end. The metal layer facing the longitudinal axis of the charge forms the penetrating jet which is thrown out with high velocity. The other part of the metal layer forms the slug, so that metal from the top of the cone forms the rear part of the slug and metal from the base of the cone forms the front part of the slug. About 15% of the metal layer forms the penetrating jet while the rest of the layer is included in the slug.

As already mentioned, due to the specific design and location of the ring 11, also a separate jet part 4 is formed, which part has a much higher velocity than the slug 3 or a velocity which is only a little smaller than the velocity of the rear parts of the penetrating jet. The ring forms a part 4 having a weight of about 27 grams. The rest of the ring material is included in the slug 3.

The invention is not limited to this embodiment but can be modified within the scope of the claims. For instance instead of a separate ring, the ring could also be integrated with the metal layer 10 and have another configuration and location. Furthermore it is not necessary that the space 8*a* is annular.

INDUSTRIAL APPLICABILITY

The hollow charge according to the invention comprises components which are easy to manufacture and assemble in production for shells or the like.

We claim:

1. An improved explosive charge of causing a primary effect in which a hole is made in a wall of a target and a secondary effect in which charge material passes through the hole into the target, said explosive charge comprising:

a body of explosive material;

an outwardly opening cavity formed in said body, said cavity enlarging toward the burst direction of said charge, said cavity being lined with a layer of metal so that upon initiation of said charge a forwardly directed penetrating jet of high velocity material is formed for causing said primary effect, said jet being followed in the burst direction by a slug of comparatively low velocity material; and a substantially cylindrical, annular body separate from said metal layer, said annular body having a rearward end in contact with the forward end of said metal layer so that upon initiation of said charge, said annular body deforms to generate a separate part of said jet, said separate part being in the form of a projectile which follows closely the rear portion of said jet for causing said secondary effect, said separate part having a velocity substantially the same as the velocity of the rear portion of said jet, whereby said separate part can penetrate and enlarge a hole made in a target to facilitate passage of said slug.

2. A charge according to claim 1, wherein said annular body forms a separate part having a velocity no more than 1000 m/s less than said velocity of said rear portion of said jet.

3. A charge according to claim 2, wherein said annular body forms a separate part having a velocity no more than 500 m/s less than said velocity of said rear portion of said jet.

4. A charge according to claim 1, wherein said substantially cylindrical, annular body is partly countersunk into said body of explosive material; so that, a part of said body of exposive material surrounds at least the rearward portion of the outer surface of said annular body.

5. A charge according to claim 4, wherein explosive surrounds more than 50% of the axial length of said annular body, from the rearward end thereof forward.

6. A charge according to claim 5, wherein the explosive surrounding said annular body is in the form of an annulus whose thickness in the radial direction is from 2–10% of the outer diameter of said body of explosive material.

7. A charge according to claim 5, wherein explosive surrounds more than 60–90% of the axial length of said annular body.

8. A charge according to claim 7, wherein the explosive surrounding said annular body is in the form of an annulus whose thickness in the radial direction is from 2–10% of the outer diameter of said body of explosive material.

9. A charge according to claim 4, wherein the explosive surrounding said annular body is in the form of an annulus whose thickness in the radial direction is from 2–10% of the outer diameter of said body of explosive material.

10. A charge according to claim 1, wherein said annular body has a substantially the same thickness as said layer of metal.

11. A charge according to claim 1, wherein said body of explosive material is enclosed in an outer casing and said annular body is provided with external threads for engaging corresponding internal threads of said outer casing.

12. A charge according to claim 1, wherein said annular body is formed of zirconium, titanium or aluminum.

13. A charge according to claim 1, wherein the weight of said annular body is 100–250 grams.

14. A charge according to claim 4, wherein the weight of said annular body is 100–250 grams.

* * * * *